US007078684B2

(12) United States Patent
Beu et al.

(10) Patent No.: US 7,078,684 B2
(45) Date of Patent: Jul. 18, 2006

(54) HIGH RESOLUTION FOURIER TRANSFORM ION CYCLOTRON RESONANCE (FT-ICR) MASS SPECTROMETRY METHODS AND APPARATUS

(75) Inventors: Steven C. Beu, Austin, TX (US); Greg T. Blakney, Tallahassee, FL (US); John P. Quinn, Havana, FL (US); Christopher L. Hendrickson, Tallahassee, FL (US); Alan G. Marshall, Tallahassee, FL (US)

(73) Assignee: Florida State University, Tallahasee, FL (US)

( * ) Notice: Subject to any disclaimer, the term of this patent is extended or adjusted under 35 U.S.C. 154(b) by 0 days.

(21) Appl. No.: 11/051,092

(22) Filed: Feb. 4, 2005

(65) Prior Publication Data

US 2005/0178961 A1 Aug. 18, 2005

Related U.S. Application Data

(60) Provisional application No. 60/542,213, filed on Feb. 5, 2004.

(51) Int. Cl.
*H01J 49/34* (2006.01)
*H01J 49/26* (2006.01)

(52) U.S. Cl. ..... 250/291; 250/292; 250/282; 250/288; 250/281

(58) Field of Classification Search ..... 250/282, 250/291, 292, 288, 281
See application file for complete search history.

(56) References Cited

U.S. PATENT DOCUMENTS

| | | | | |
|---|---|---|---|---|
| 4,755,670 | A * | 7/1988 | Syka et al. | 250/292 |
| 5,248,882 | A * | 9/1993 | Liang | 250/291 |
| 5,256,875 | A * | 10/1993 | Hoekman et al. | 250/282 |
| 5,654,542 | A * | 8/1997 | Schubert et al. | 250/282 |
| 5,703,358 | A * | 12/1997 | Hoekman et al. | 250/282 |
| 6,114,692 | A * | 9/2000 | Beu | 250/282 |
| 6,403,955 | B1 * | 6/2002 | Senko | 250/290 |
| 6,822,223 | B1 * | 11/2004 | Davis | 250/282 |

* cited by examiner

*Primary Examiner*—Nikita Wells
*Assistant Examiner*—Johnnie L Smith, II
(74) *Attorney, Agent, or Firm*—Akerman Senterfitt; Neil R. Jetter

(57) ABSTRACT

A high resolution Fourier Transform Ion Cyclotron Resonance (FT-ICR) mass spectrometry system includes excitation circuitry including an excitation amplifier for generating an electrical excitation signal and excitation electrodes for applying an oscillating electric field to excite ions in the system. Detection circuitry including detection electrodes measures a detection signal which includes a plurality of signal values including signal values induced by the ions. Structure is provided for reducing or canceling coupling of the excitation signal into the detection signal, wherein simultaneous excitation and detection is used. A computing structure generates a Fourier transformed frequency domain representation of the detection signal and deconvolves the frequency domain representation using complex division to separate a dispersion spectrum portion and an absorption spectrum portion.

13 Claims, 14 Drawing Sheets a) Initial Phase = 0 degrees b) Initial Phase = 45 degrees (a) (b)

ABSORPTION MODE RESOLVING POWER ADVANTAGE:

| | |
|---|---|
| NO COLLISIONS | 2.00 |
| LANGEVIN: | 1.73 |
| HARD-SPHERE: | 1.40 |

Sources of excite/detect coupling

Insert variable capacitor between each Excite/detect electrode pair

HIGH RESOLUTION FOURIER TRANSFORM ION CYCLOTRON RESONANCE (FT-ICR) MASS SPECTROMETRY METHODS AND APPARATUS

CROSS-REFERENCE TO RELATED APPLICATIONS

This application claims the benefit of U.S. Provisional Application No. 60/542,213 entitled "High Resolution Fourier Transform Ion Cyclotron Resonance (FT-ICR) Mass Spectrometry Method and Apparatus filed on Feb. 5, 2004, the entirety of which is incorporated herein by reference.

STATEMENT REGARDING FEDERALLY SPONSORED RESEARCH OR DEVELOPMENT

The United States Government has certain rights in this invention pursuant to National Science Foundation (NSF) Grant/Contract No. CHE-99-09502.

FIELD OF THE INVENTION

This invention relates generally to mass spectrometry and more particularly to an apparatus and method for high resolution Fourier transform ion cyclotron resonance (FT-ICR) mass spectrometry.

BACKGROUND

Fourier transform ion cyclotron resonance (FT-ICR) mass spectrometry is a well known method that offers higher mass resolution, greater mass resolving power, and higher mass accuracy than other known mass analysis methods. The principles of FT-ICR are described in several recent review articles. These review articles include: A. Marshall, C. Hendrickson, G. Jackson, Fourier Transform Ion Cyclotron Resonance Mass Spectrometry: A Primer, Mass Spectrometry Reviews, Volume 17, 1998, pp. 1–35; A. Marshall, Milestones in Fourier Transform Ion Cyclotron Resonance Mass Spectrometry Technique Development, International Journal of Mass Spectrometry, Volume 200, 2000, pp. 331–356; T. Wood, Electrospray Ionization Fourier Transform Mass Spectrometry of Macromolecules: The First Decade, Applied Spectroscopy, Volume 53, No. 1, 1999, pp. 18A–36A, and A. Marshall and C. Hendrickson, Fourier Transform Ion Cyclotron Resonance Detection: Principles and Experimental Configurations, International Journal of Mass Spectrometry, Volume 215, 2002, pp. 59–75.

The performance of FT-ICR is achieved through the combination of electric and magnetic fields, and is based upon the principle of ion cyclotron resonance (ICR). Ions in the presence of a uniform static magnetic field are constrained to move in circular orbits in the plane perpendicular to the direction of the magnetic field and are unrestricted (by the magnetic field) to move parallel to the magnetic field direction. The radius of this circular motion is dependent on the momentum of the ions in the plane perpendicular to the magnetic field. The frequency of the circular motion (cyclotron frequency) is a function of the mass-to-charge (m/z) ratio of the ion and the magnetic field strength. Trapping electrodes provide a static electric field, which prevent the ions from escaping along the direction of the magnetic field lines. The ions are confined within the trap. As long as the vacuum is kept high (typically $<10^{-8}$ to $10^{-10}$ mbar), ion/neutral collisions are minimized and the ion trapping duration is maximized.

When the ions are initially trapped, they have an initial low amplitude cyclotron radius defined by their thermal velocity distribution and their initial radial positions. This low amplitude motion is of random initial phase. This state is referred to generally as "incoherent" oscillatory motion. While these ions are trapped, an oscillating electric field can be applied perpendicular to the magnetic field causing those ions having a cyclotron frequency equal to the frequency of the oscillating electric field to resonate. The resonant ions absorb energy from the oscillating electric field, accelerate, gain kinetic energy and move to larger orbital radii. This process, termed "ion excitation", adds a large amplitude coherent cyclotron motion on top of the low initial thermal amplitude incoherent cyclotron. The net effect is that ions of a given cyclotron frequency, and hence mass, orbit as a packet. When the applied excitation field is switched off, the ions stop absorbing energy and the packet then orbits the chamber at the fundamental cyclotron frequency of the ions that comprise the packet. The ion packet produces a measurable signal by inducing onto nearby electrodes an image-charge that oscillates at the same cyclotron frequency. This charge induces an oscillating current in circuitry attached to the electrodes, and this signal current can be amplified, detected, digitized, and stored in computer memory. The measured signal is typically in the form of a damped sine wave function with the characteristic cyclotron frequency as described above. The mass spectrum is obtained by application of a Fourier transform to the measured time domain induced signal to extract the cyclotron frequencies associated with the various ions. Once the cyclotron frequencies are known, the m/z values are calculated using a modified, two term version of the cyclotron equation that accounts for both the magnetic and electric fields.

The spectral peak width actually achieved by FT-ICR systems is affected by many factors. Principal among these are instrumental factors such as the strength and homogeneity of the magnetic and electric fields. The goal of achieving higher resolving power is typically pursued at the great expense of developing larger, higher-field magnets. Although these instrumental factors are of primary importance, the computational procedures employed to obtain spectra from the acquired time domain data can also have a significant affect on the achieved peak width. Many different approaches to extraction of frequency from the time domain data have been explored. However, the most common procedure is to perform an apodization (or "windowing") to suppress the broad base of the true frequency domain peak(s) that correspond to the true shape of the time-domain data, followed by zero fill and fast Fourier transform (FFT) to yield the desired frequency spectrum.

As long as the magnetic field in which ions are confined is relatively homogeneous, the various frequencies in the generated frequency spectrum accurately represent the ion cyclotron frequencies. Accordingly, the mass-to-charge (m/z) ratio of the various ions from a given sample can be measured with high accuracy.

However, the resolving power of conventional FT-ICR systems is not optimized because each of the complex components of the corresponding frequency spectrum derived from the measured time domain detection data set generally includes a mixture of the absorption and dispersion modes. This is because factors such as the time delay between the excitation and detection events, as well as temporally dispersed excitation events (e.g. frequency-sweeps) result in continuous variation of phase with frequency in the time domain detection data set. The mixing of absorption and dispersion modes makes the resulting peak shapes highly asymmetrical. FIG. 1 shows a conventional excitation and detection sequence showing a time delay prior to start of detection and digitation to avoid excitation induced detection preamplifier saturation.

Conventional FT-ICR systems utilize a magnitude mode spectral display to restore peak symmetry at the expense of spectral resolution that would be available from a pure absorption mode spectrum. Alternatively, some form of phase correction is sometimes applied to restore a pure absorption-mode peak shape. However, available methods for phase correction have been limited to narrow spectral bandwidth and require manual data manipulation to "tune" the correction process.

SUMMARY

A high resolution Fourier Transform Ion Cyclotron Resonance (FT-ICR) mass spectrometry system includes excitation circuitry including an excitation amplifier for generating an electrical excitation signal and excitation electrodes for applying an oscillating electric field to excite ions in the system. Detection circuitry including detection electrodes measures a detection signal which comprises a plurality of signal values including signal values induced by the ions. Structure is provided for reducing or canceling coupling of the excitation signal into the detection signal, wherein simultaneous excitation and detection is used. A computing structure generates a Fourier transformed frequency domain representation of the detection signal and deconvolves the frequency domain representation using complex division to separate a dispersion spectrum portion and an absorption spectrum portion. Once separated, the pure absorption mode spectrum provides significantly enhanced spectral resolution relative to conventional magnitude mode spectrums.

The Fourier transform can comprises a fast Fourier transform (FFT). In a preferred embodiment, the ion cyclotron radii of the ions are less than about one half of a trapped-ion cell radius of the ions.

The structure for reducing or canceling coupling can comprise at least one electrical network, the electrical network being disposed between at least one of the detection electrodes and at least one of the excitation electrodes. The electrical network generates opposite-phase signals having substantially equal amplitudes to cancel signals associated with the excitation signal which couple into the detection signal. The electrical network can comprise at least one variable capacitor.

In another embodiment of the invention, the structure for reducing or canceling coupling comprises a signal processor which implements an algorithm which identifies signal values in the plurality of signal values resulting from coupling of the excitation signal, and replaces the identified values with alternative values. The alternate values reduce effects of the coupling. The replacement values can comprise zeros or an arithmetic average of the plurality of signal values excluding the identified signal values.

A high resolution method of Fourier Transform Ion Cyclotron Resonance (FT-ICR) mass analysis comprises the steps of synchronizing ion excitation generated by an excitation signal and detection of ions generated by the ion excitation to be simultaneous, wherein a detection response comprising a plurality of signal values is obtained. The detection response is Fourier transformed to obtain a frequency domain representation of the detection response. Fourier deconvolving of the frequency domain representation using complex division is then used to obtain an absorption spectrum separate from a dispersion spectrum.

The method can further comprise the step of reducing or canceling a coupled excitation signal in the detection response by electronically combining substantially equal amplitude signals having opposite phases. In an alternate embodiment, the method further comprises the steps of identifying signal values in said plurality of signal values resulting from coupling of the excitation excite signal, and replacing the identified values with alternative values, the alternate values reducing effects of the coupling. The ion excitation and the detection of ions can begin at virtually the same instant in time.

BRIEF DESCRIPTION OF THE DRAWINGS

A fuller understanding of the present invention and the features and benefits thereof will be obtained upon review of the following detailed description together with the accompanying drawings, in which.

DETAILED DESCRIPTION

The result from a Fourier transform is a mathematically complex data set representing the amplitude and phase of each frequency component present in the original time domain data set. The amplitude for any given frequency element in this data set is represented by the magnitude of the corresponding complex number, and the phase (relative to the starting point of the time domain data set) is represented by the arctangent of the ratio of the real and imaginary components of the complex number. Because a continuous phase variation is typical in conventional FT-ICR systems, it is generally the case that the initial phase for a particular frequency component will not be an integer multiple of π radians. Thus, the complex frequency domain spectrum will exhibit mixed absorption and dispersion modes with resulting asymmetric peaks.

This mixing generally leads those in the art to use a magnitude mode spectral display to restore peak uniformity and symmetry, at the expense of spectral resolution. The invention overcomes this compromise through a new phase correction technique without being limited to a narrow spectral bandwidth and the requirement of user interaction to tune the correction process according to known phase correction-methods.

Figure 2:
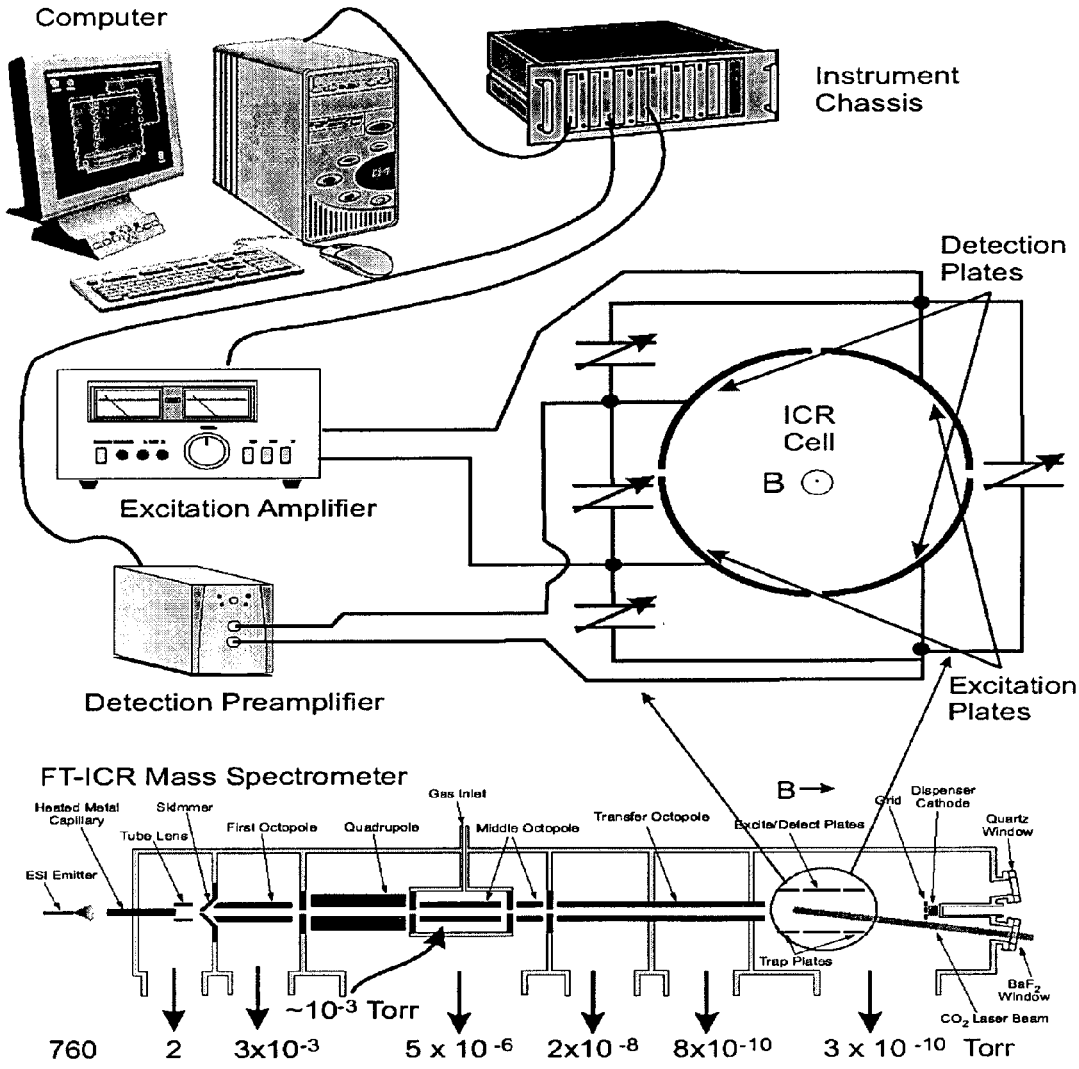
FIG. 2 shows an exemplary high resolution FT-ICR mass spectrometer system according to an embodiment of the invention.

FIG. 2 shows an exemplary high resolution FT-ICR mass spectrometer system 200 according to an embodiment of the invention that includes an electrospray ion source having an electrospray emitter 210 to produce and propel ions out from a given sample (not shown). Although an electrospray source 210 is shown in FIG. 2, other ion sources can be used with the system 200, including a MALDI source, an electron source, a photon source, field desorption source, or other source. A vacuum pumping system (not shown) which can attain ultra-high vacuum (preferably $<10^{-9}$ torr) is provided for supplying high vacuum conditions for the system 200. Typical pressures achieved by the pump are shown at various sections of system 200. The ion trap analyzer cell 220 is situated in the homogeneous B field region of a large magnet (not shown), preferably being a superconducting magnet. The ion trap analyzer 220 includes excitation circuitry comprising excitation amplifier 225 coupled to excitation electrodes 226 and 227 for applying an oscillating electric field to excite ions in the trap, wherein the ions absorb power from the oscillating-electric field. The ion trap analyzer 220 also includes detection circuitry comprising detection preamplifier 231 coupled to detection electrodes 233 and 234 which is provided for measuring the detection signal induced by the ions.

System 200 includes structure which permits system operation where ion excitation and detection begins substantially simultaneously. FIG. 2 shows a capacitor-based decoupling network comprising capacitors 241–244 disposed between the excitation electrodes-4. 226 and 227 and detection electrodes 233 and 234. As used herein, simultaneous excitation and detection (SED) refers to a detection interval that incorporates at least a portion of the excitation interval and thus proceeds concurrently, with detection preferably beginning at virtually the same instant in time as the excitation, such as within one sampling period of any associated analog-to-digital conversion of the detection signal. A computing structure 250 receives the detection signal from detection preamplifier 231 and the excitation signal from excitation amplifier 225. Computing structure 250 generates Fourier transformed frequency domain representations of the detection and excitation signals and then deconvolves the frequency domain representation obtained using complex division of the frequency domain representation of the detection signal by the frequency domain representation of the excitation signal to separate the dispersion spectrum portion and the absorption spectrum portion. Spectral results obtained are preferably provided to a storage and/or readout device, such as a CRT or LED screen 255, or can be transmitted over the air to one or more remote devices.

Figure 3:
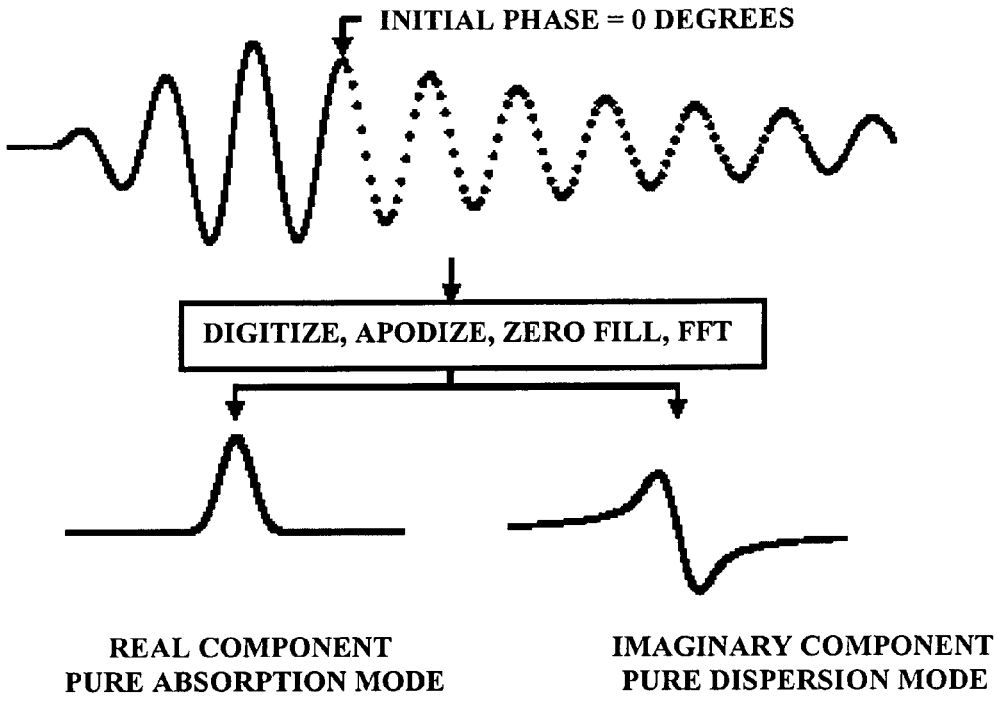
FIG. 3 shows pure absorption and dispersion mode spectra resulting from a FFT when the signal phase is 0 degrees at the start of the detected time domain data set.
Figure 4:
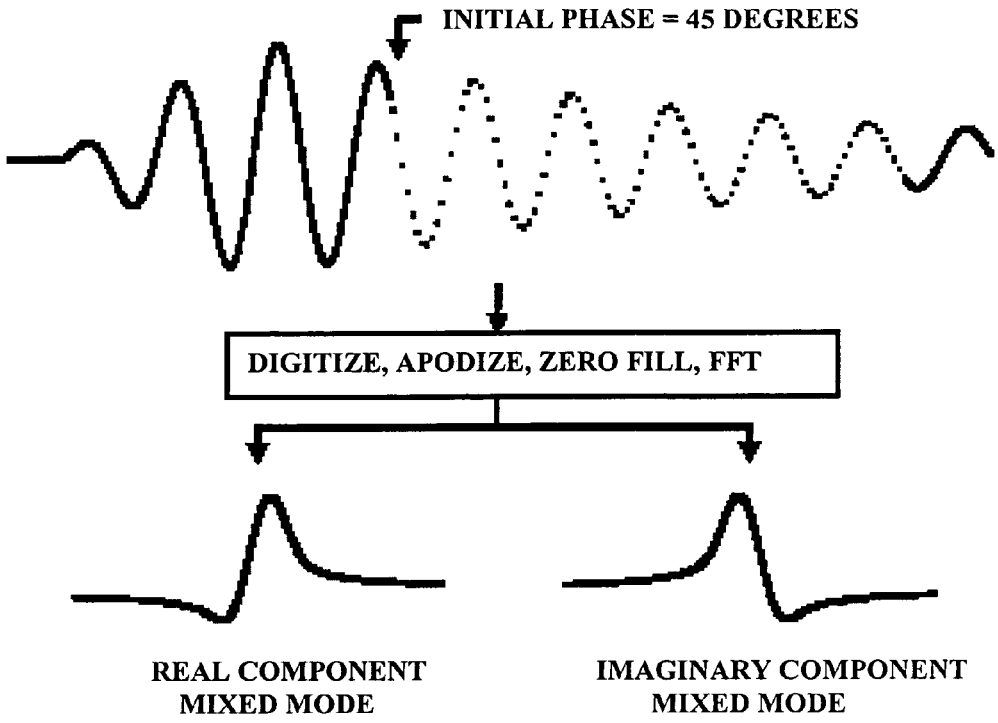
FIG. 4 shows mixed mode spectra resulting from a FFT when the signal phase is not 0 (or not an integer multiple of $\pi$) degrees.

FIG. 3 shows a pure absorption (real component) and dispersion (imaginary component) spectra resulting from a FFT when the signal phase is 0 degrees (or integer multiple of π radians) at the start of the detected time domain data set. In comparison, FIG. 4 shows mixed mode spectra resulting from a FFT when the signal phase is 45 degrees at the start of the detected time domain data set. It can be seen that the real component (absorption mode) obtained is highly symmetric when the signal phase is 0 degrees (FIG. 3), while the real component (now mixed absorption and dispersion modes) is highly asymmetric and thus significantly broadened when the signal phase is 45 degrees.

Figure 5:
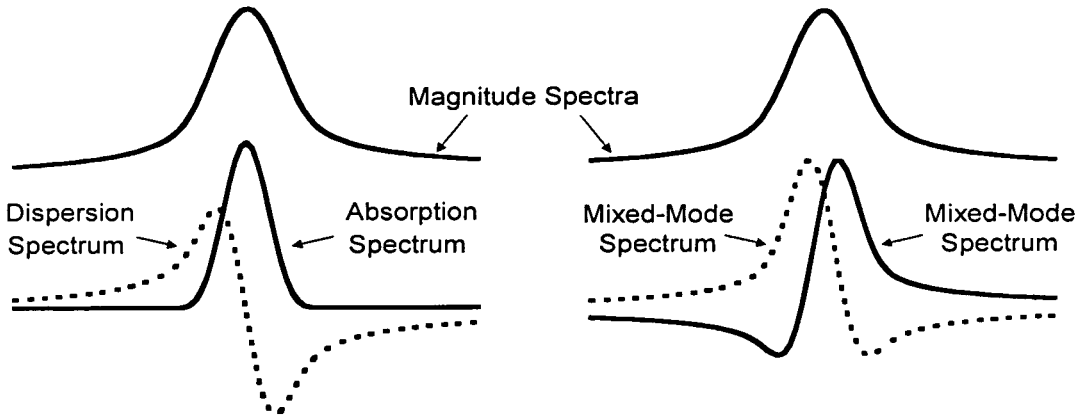
FIGS. 5(*a*) and (*b*) show examples of a magnitude mode display for an initial; phase of 0 degrees, and an initial phase of 45 degrees, respectively. The magnitude mode displays are symmetric for both cases, indicating the insensitivity of the magnitude mode display to signal phase.

FIGS. 5(*a*) and (*b*) show magnitude mode displays for an initial phase of 0 degrees at the start of the detected time domain data set, and an initial phase of 45 degrees, respectively. The magnitude mode displays are symmetric for both cases, indicating the insensitivity of the magnitude mode display to signal phase. The magnitude in the magnitude mode display is given as follows:

$$\text{Magnitude}=(\text{Imaginary}^2+\text{Real}^2)^{1/2}$$

This insensitivity is why typical FT-ICR systems generally use magnitude mode spectral displays to restore peak symmetry at the expense of spectral resolution that would be available from a pure absorption mode spectrum.

If the phase of each frequency component is made to be either zero (or an integer multiple of π radians) at the start of a FT-ICR data set, the real and imaginary components of the corresponding complex frequency spectrum are orthogonal to one another, and thus independently represent the pure absorption and dispersion mode spectra, respectively. Thus, Fourier deconvolution via complex division of the uncorrected frequency spectrum by the excitation frequency spectrum can be used to provide phase correction over the entire excitation bandwidth. This process allows isolation of the pure absorption spectrum from the detected signal.

In a preferred embodiment of the invention, SED according to the invention is made possible by a decoupling network that decouples the detection signal from the excitation signal. This allows the Fourier deconvolution process to be used directly on the uncorrected detected signal, which can provide narrowband or broadband phase correction.

Figure 6:
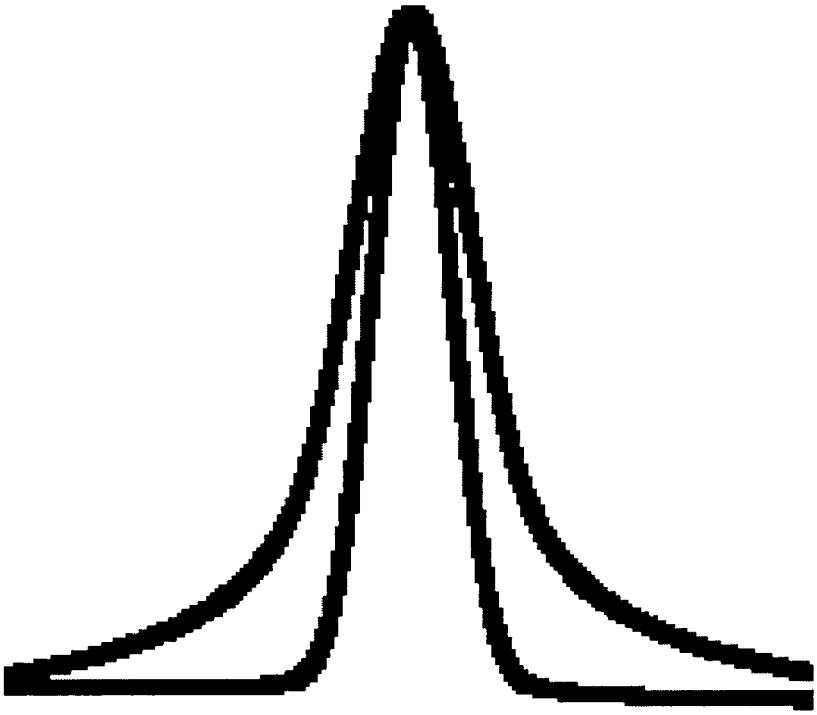
FIG. 6 shows the resolving power advantage provided by a pure absorption mode display according to the invention, and the expected resolving power enhancement for various signal damping conditions.

FIG. 6 shows the resolving power advantage provided by a pure absorption mode display according to the invention, and the expected resolving power enhancement for various signal damping conditions. The outer peak is a magnitude mode peak typical of conventional systems, while the inner peak is an exemplary absorption mode peak according to the invention.

The goal of phase correction is to obtain a spectrum in which all frequency components exhibit pure absorption mode peak shape. As noted above, this ideal corresponds to a time domain data set in which all of the signal components in the detection signal at the various frequencies each have an initial phase of zero or an integer multiple of π radians. Unfortunately, such an ideal time domain response can only be obtained with a similarly ideal excitation event that instantaneously excites all frequencies simultaneously at the start of the measurement. This ideal cannot be approached under typical experimental conditions in FT-ICR MS because such an excitation would require impractically high amplitudes and short durations. Typical excitations will therefore employ some distribution of frequency versus time (e.g. frequency sweep) with a corresponding variation of phase with frequency that will also be manifest in the detection signal that results from the excitation. Additional frequency dependent phase variation also results from the delay that is typically incorporated between the excitation and detection events.

Figure 7:
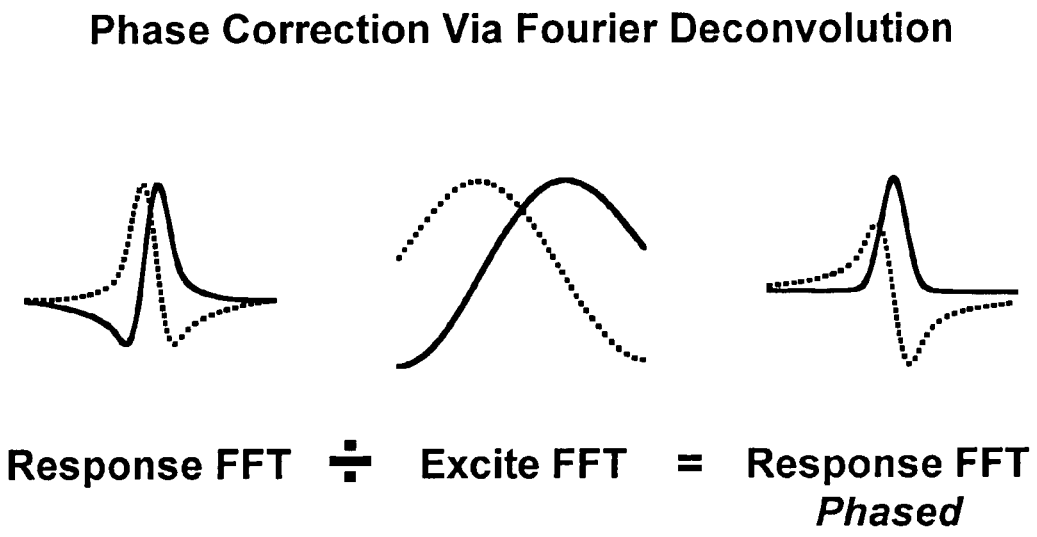
FIG. 7 shows phase correction via a Fourier deconvolution process according to the invention.

Fortunately, the inventors have found that ion behavior that prevails during typical conditions is such that the desired ideal absorption mode response data can be recovered from the non-ideal magnitude mode experimental response. When ion cyclotron radii are limited to less than about one half of the trapped-ion cell radius, both the excitation and detection processes in ICR are linear. Therefore, the radius of the ion cyclotron motion after excitation is a linear function of the excitation signal amplitude, and the amplitude of the detected image current is a linear function of the ion cyclotron radius. Under these circumstances, the detected time domain ion signal is simply the convolution of the applied excitation waveform and the desired ideal ion response. Because the convolution of two time domain functions is equivalent to the product of their respective Fourier transforms, the absorption mode spectrum that corresponds to the desired ideal response can be recovered via complex division of the spectrum of the observed response by the spectrum of the excitation. FIG. 7 shows phase correction via a Fourier deconvolution process according to the invention. The Fourier deconvolution process effectively yields phase correction over the entire excitation bandwidth, while simultaneously correcting for any spectral variation resulting from non-uniform power distribution over the excitation bandwidth.

As noted above, an important requirement for implementing the phase correction via Fourier deconvolution according to the invention is that the detection event incorporates the excitation interval, and the excitation and detection spectra must be temporally synchronized. In practice, this SED is made difficult by the coupling that exists between the excitation and detection circuits. This coupling is primarily due to the capacitance that exists between leads and electrodes comprising the excitation and detection circuits of FT-ICR systems.

Figure 1:
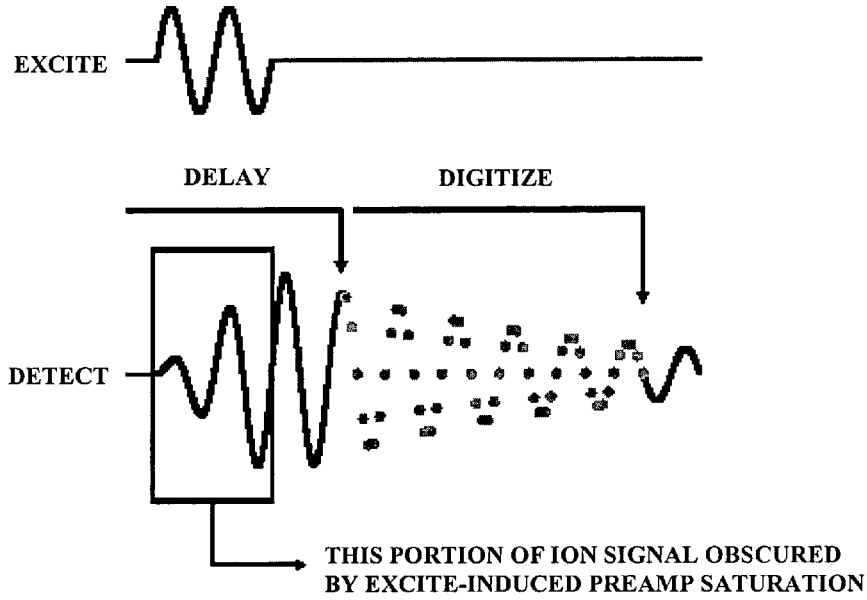
FIG. 1 (Prior Art)
FIG. 1 shows a conventional excitation and detection sequence showing a time delay prior to the start of detection and digitation to reduce excitation coupling and resulting excitation induced preamplifier saturation.
Figure 8:
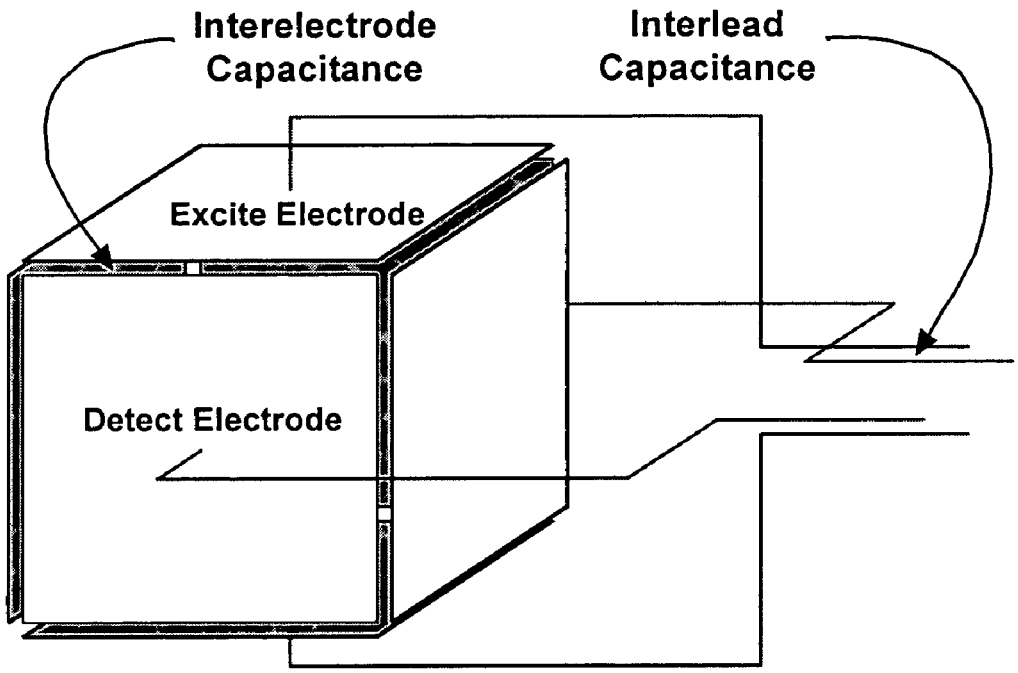
FIG. 8 shows common sources of excitation/detection circuitry cross-coupling including interlead capacitance and interelectrode capacitance.
Figure 9:
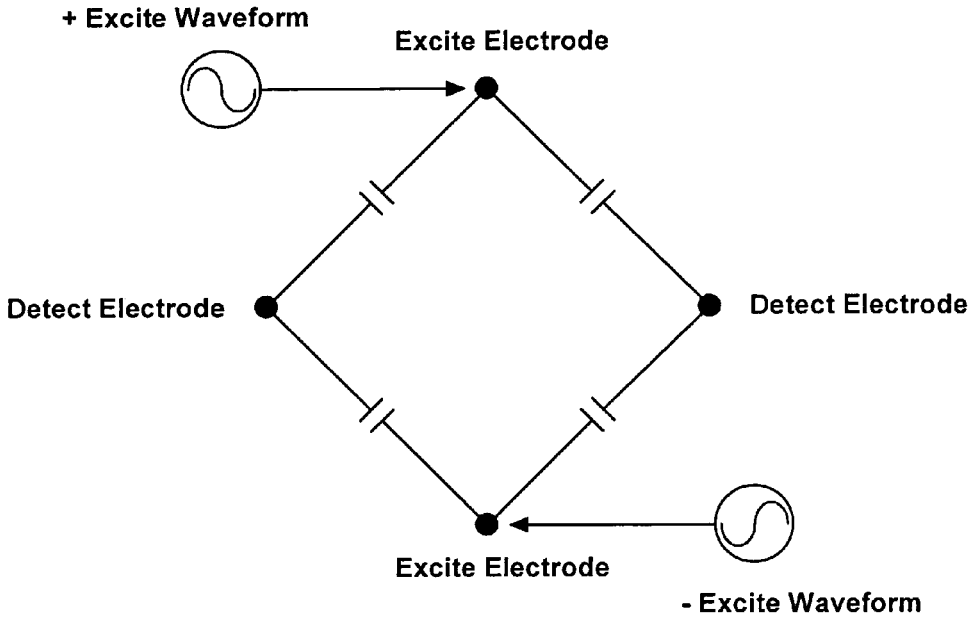
FIG. 9 shows parasitic interelectrode capacitances along with an excitation waveform applied across the excitation electrodes.

FIG. 8 shows some sources of excite/detect coupling including parasitic interlead capacitance and interelectrode capacitance. In current systems, the typically large excitation signal induced via capacitive coupling into the detection circuit through parasitics requires incorporation of a delay between the excitation and detection events to avoid contamination of the detection signal, as well as to allow for recovery after saturation of the detection preamplifier, as noted relative to FIG. 1. FIG. 9 represents the interlead and interelectrode capacitance as parasitic interelectrode capacitors 910–913 and shows an excitation waveform applied across the excitation electrodes 915 and 920. Through the parasitic interelectrode capacitors 910–913 the excitation waveform is coupled from excite electrodes 915 and 920 to detection electrodes 930 and 935. In conventional systems, this coupling requires incorporation of a delay between excitation and detection events which results in mixed mode spectra, such as the spectra shown in FIG. 4.

Figure 10:
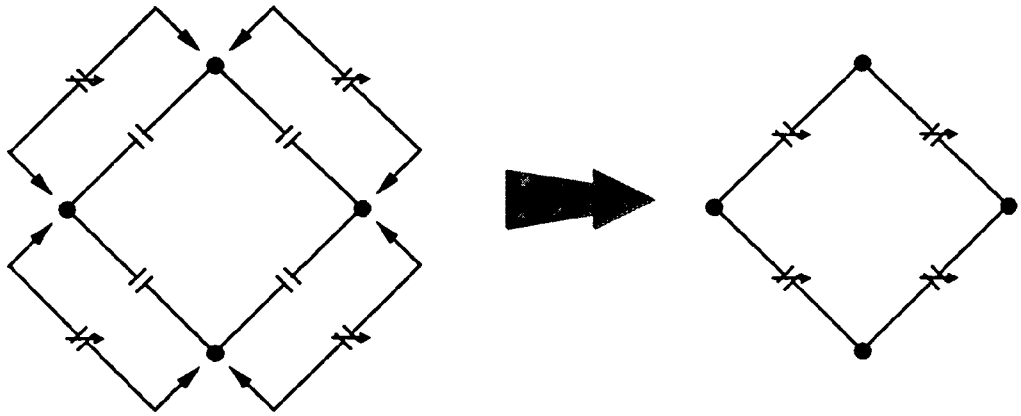
FIG. 10 shows the insertion of variable capacitors between each excitation/detection electrode pair which permits the time delay between excitation and detection events to be eliminated, or at least significantly reduced.

According to a preferred embodiment of the invention, the need to use a delay between excitation and detection events can be avoided, or at least greatly reduced, using an electrical network for decoupling disposed between the respective electrodes. For example, FIG. 10 shows the insertion of variable capacitors 1010–1040 between each excite/detect electrode pair. The variable capacitors 1010–1040 are disposed in parallel to parasitic capacitances 910–913. Each capacitor should be of a type and range sufficient to achieve a maximum capacitance that is greater than or equal to the maximum difference between the equivalent parasitic coupling capacitances of FIG. 9. Using the configuration shown in FIG. 10, the variable capacitors 1010–1040 are disposed between each excitation and detection electrode lead pair.

The resulting bridge is preferably tuned such that the coupling of the two opposite-phase components of the differential excitation are of equal amplitude to cancel each other at the detection preamplifier input. This tuning is preferentially achieved with respect to each preamp input by initially setting each of the two variable capacitors associated with that input to their minimum capacitance setting, and then observing the coupled signal from each excitation input to that preamp input independently. The setting of the variable capacitor associated with the more weakly coupled excite input is then adjusted to increase the amplitude of the coupling to just match that of the more strongly coupled excitation input. Because the two coupled excitation signals are of opposite phase, they combine so as to null the total coupled excitation signal at that preamp input. This tuning procedure is preferably performed independently for each preamp input, and it is generally the case that there will be some residual coupled excitation signal present at each input.

Further tuning may be achieved by adjusting the capacitors associated with the preamp input exhibiting the smaller residual signal such that it becomes of equal amplitude and phase to the larger residual signal. The differential amplification process will then cause the two residual signals to cancel and yield an overall minimum coupled signal at the preamp output. With a differential preamp, this tuning process can in principal be accomplished with only a single variable capacitor (not shown) inserted such that the coupled excitation at one preamp input can be tuned to balance the coupled excitation at the other preamp input. In this case cancellation occurs solely via the differential amplification process.

The arrangement of FIG. 10 offers the advantage of allowing individual cancellation of the coupled signal appearing at each preamp input, and thereby avoids the possible saturation of either input while also minimizing the role of the preamp in the cancellation process. It is the case for either arrangement that the tuning process may be readily automated so as to avoid the need for manual tuning, and that once tuned a system will not require retuning unless there is some physical change to the FT-ICR system.

Alternative electrical networks, both active and/or passive (not shown), may be employed to substantially reduce the signal that is induced in the detection circuit by the excitation. For example, variable inductors can be employed alone, or in combination with variable capacitors, to achieve substantial reduction of the coupled signal in a manner analogous to that described above. Because the combination of reactive coupling sources can result in a variation of coupling with frequency, a compensating reactive combination in the decoupling network could be advantageous in the cancellation process. An active decoupling network could also be used (alone or in combination with passive components) to amplify, or independently generate, the signal required for the cancellation process. This approach would extend the decoupling process to those systems in which there is no inherent source of an opposite-phase signal to be used for the cancellation process. The common objective in all of approaches described above is to effectively reduce or cancel the coupled excitation signal in the detection signal by electronically combining a similar but opposite-phase signal.

According to another embodiment of the invention, SED is implemented without the need for an electrical network for reducing or eliminating the coupled excitation signal from the detection signal. In this embodiment, prior to phase correction via Fourier deconvolution according to the invention, all signal values in that portion of the resulting detection signal that were acquired during excitation (and therefore manifest the effects of the coupled excitation signal) are replaced with alternative values via computer processing. For example, alternative values can be zero or values equal to the arithmetic average of all values in the remaining detection signal. The result of this procedure is similar to that obtained with the electrical decoupling network in that it removes the effects of the coupling on the spectrum that results from Fourier transformation and phase correction of the detection signal. However, unlike the results obtained with electrical decoupling, this modification of the detection signal will generally result in the appearance of corresponding artifacts (baseline perturbations) in the spectrum obtained. The magnitude of these artifacts will scale with the length of the modified portion relative to the overall length of the detection signal, and for typical FT-ICR experimental conditions will be small. This is because the length of the detection signal that exhibits coupling and requires modification is determined by the duration of the excitation, and this duration is typically much shorter than the duration of the detection signal With this embodiment it is therefore advantageous to use higher amplitude, shorter duration excitation, with the result that a smaller relative portion of the detection signal will require modification and the magnitude of the corresponding artifacts will be minimized.

The invention also inherently corrects for peak area variations resulting from the excitation waveform having non-uniform power distribution over the desired excitation bandwidth. Nonuniform excitation power distribution causes variation in ion cyclotron radius over the excitation bandwidth. Because the detected ion signal is approximately proportional to cyclotron radius as well as the ion abundance, this results in variation in signal magnitude and incorrect relative ion abundance measurements. These variations are mathematically compensated by the described Fourier deconvolution process, which involves complex division of the observed spectrum by the nonuniform excitation spectrum.

Previous studies have demonstrated that interference of closely spaced peaks in magnitude mode spectra can result in systematic errors in the assignment of peak frequencies. These errors result because in contrast to absorption spectra, magnitude spectra are non-additive. The extent of these errors is known to depend on several factors including the degree of peak overlap, the use of windowing functions, and the signal damping rate, as well as the relative phase of the overlapping peaks. Although appropriate manipulation of these factors can reduce frequency (and therefore, mass) assignment errors, the underlying cause of these errors may be avoided by employing absorption mode spectral display.

In previous work, two factors were discussed that have little or no effect on magnitude-mode spectra, but can cause significant distortion of the absorption-mode spectra. These factors were the delay between excitation and detection, and failure to accurately digitize the first few points of the time domain signal, both factors that can cause baseline oscillation or "roll". SED based Fourier deconvolution according to the invention avoids both of these sources of error by eliminating the delay between excitation and detection, and by obviating the significance of the initial points of the time domain data. By starting signal digitization just prior to the start of the excitation, the digitizer is given time to stabilize before acquisition of critical data points.

The Fourier deconvolution process according to the invention can be sensitive to noise because the sources of noise in the excitation spectrum and the uncorrected sample spectrum are not correlated. In the case of uncorrelated noise, complex division will result in an overall increase in noise amplitude in the phased spectrum. Although this may be a problem for those peaks with amplitudes comparable to the noise, it is not a significant problem for higher amplitude peaks. These larger peaks may exhibit some susceptibility to phasing noise near the baseline, usually evidenced by small positive or-negative amplitude spikes on either side of the peak. As can be seen in FIGS. 5(*a*) and (*b*), the dispersion spectrum has large positive and negative amplitudes on either side of the centroid frequency. Significant noise in this region of the complex spectrum can cause "leakage" of these large amplitude dispersion-mode components into the absorption-mode spectrum, thereby resulting in associated positive or negative spikes in the corresponding region of the phased spectrum. The appearance of negative spikes is unusual to most FT-ICR MS practitioners because they are accustomed to the conventional magnitude-mode display that do not exhibit negative peaks.

The susceptibility to noise related artifacts in the phasing process may be reduced using conventional noise reduction approaches, such as signal averaging. This can be conveniently accomplished in the case of the excitation spectrum because this data does not have to be reacquired for each sample spectrum. A heavily signal-averaged excitation spectrum may be stored and reused for phasing of any sample spectrum acquired with the same relevant experimental parameters.

In addition to signal averaging, the noise content of the excitation spectrum can be further minimized by terminating acquisition of the time domain data immediately following conclusion of the excitation waveform output, and then zero-filling to match the length of sample time-domain data set. The duration of the excitation is typically much shorter than the observation time of the resulting ion signals, and employing the same observation time for the excitation as is used for the sample results in the undesirable acquisition of additional noise in the case of the excitation data.

The effects of noise may also be remedied to some extent by employing concurrent acquisition of the excitation waveform and ion signal as discussed above. The careful implementation of concurrent acquisition could yield significant noise correlation between the excitation and sample spectra and thus minimize any increase in noise resulting from the phasing process.

Although the primary goal of phasing is to enhance the resolving power of FT-ICR spectra, an important aspect of the phasing process is that it can reveal imperfection in experimental data that would otherwise be obscured by conventional data treatments and display. In an ideal experiment, the excitation and detection processes are linear, there is no change is cyclotron frequency during the detection period, the signal phase is determined solely by the excitation phase, and noise is insignificant. To the extent that the experimental results deviate from this ideal, the results of phasing will be something other than a pure absorption mode peak shape. While this result may not be aesthetically pleasing, the information that is revealed may be of significant diagnostic value. For example, a marked asymmetry in absorption mode peak shape may indicate the peak is aliased, or that it has no causal connection to the excitation (i.e. noise peak). More subtle distortions may indicate a loss of phase correlation between the excitation and the resulting ion motion, and the shape of the asymmetry may correspond to particular experimental imperfections (e.g. space charge effects, non-linearity, etc.).

The invention can be seamlessly integrated into all FT-ICR systems, whether new or through retrofit of existing systems, and will yield an approximately two-fold increase in resolving power for all spectra as compared to conventional magnitude mode spectra, resulting in improved information content. The improvement can provide advantages including more peaks resolved and more accurate mass assignments. The invention is also potentially applicable to other forms of Fourier transform spectroscopy that involve an impulse/response mechanism, provided that the mechanism yields a causal phase relationship between the impulse and response.

The invention can provide improvements to homeland security since only a FT-ICR mass spectrometer can deliver essentially "exact" mass measurements, and the invention provides improved spectral resolution of the same. Examples include clearly distinguishing $N_2$ from CO (mass 28.00615 and 27.9949, respectively) in weapon gas samples. Systems according to the invention can be mounted in vans or other motor vehicles, allowing the systems according to the invention to be readily mobile.

EXAMPLES

The present invention is further illustrated by the following specific Examples, which should not be construed as limiting the scope or content of the invention in any way.

Fourier deconvolution based phase correction was demonstrated using two different exemplary systems according to the invention. The first system included a benchtop 1.0 Tesla permanent magnet FT-ICR MS (prototype Advance Quantra, Siemens Applied Automation, Bartlesville, Okla.) using an in-cell electron ionization source. The second system included a homebuilt 9.4 Tesla FT-ICR MS equipped with an external electrospray ionization (ESI) source. Both instruments were equipped with a decoupling network comprising an external variable capacitor bridge between the excitation and detection leads and electrodes. Although the bridge was manually adjusted to minimize the detected excitation signal during SED, an automatic system can be provided for automatic adjustment of the bridge. Although the goal of the nulling process is to achieve complete cancellation of the coupled excitation signal, this can be more difficult to achieve on larger high-field instruments, such as the 9.4 Tesla system, because of greater coupling capacitance with large cells and the required use of higher amplitude excitation waveforms.

However, it is often sufficient for some applications to achieve a residual coupled excitation signal that is small enough that it does not exceed the dynamic range of the detection preamplifier when combined with the acquired ion signals. The residual excitation signal is generally highly reproducible and can be removed from the SED time domain transients using background subtraction. In this case, the background transient is obtained simply by acquiring SED transients in the absence of sample ions.

Although excitation and detection events occurred concurrently in the SED experiments performed, acquisitions of time domain data for excitation waveforms and detected ion signals were performed separately. This is because concurrent acquisition of both time domain data sets would require duplicate parallel sets of acquisition circuitry and computer memory, as well as software modifications to control the simultaneous acquisitions. The approach including parallel sets of acquisition circuitry and computer memory to control the simultaneous acquisitions could in principal offer superior results because the acquired excitation data would be more representative of what the sample ions actually experienced during the SED experiment. However, a disadvantage of this approach is the significantly greater instrumental costs and experimental complexity. The simpler alternative approach used herein was to acquire the data sets in separate experiments using identical instrument parameters and timing sequences. For both instruments, spectra of the excitation waveforms were obtained by directly coupling the excitation and detection circuits with appropriate attenuation to avoid saturation of the detection preamplifier. The coupling was accomplished as close to the cell as possible, and included the preamplifier, so that the excitation waveform was acquired with an excitation and detection signal path as similar as possible to that used during ion detection. This procedure helps ensure that the detected excitation and ion signals are both subject to the same signal path induced phase shift.

Time domain data for both xenon and ubiquitin samples were initially subjected to background subtraction to remove any residual excitation signal evident during SED. All time domain data were then subjected to half-Hanning apodization and a single zero-fill prior to applying the fast Fourier transform and deconvolution procedure.

Figure 11:
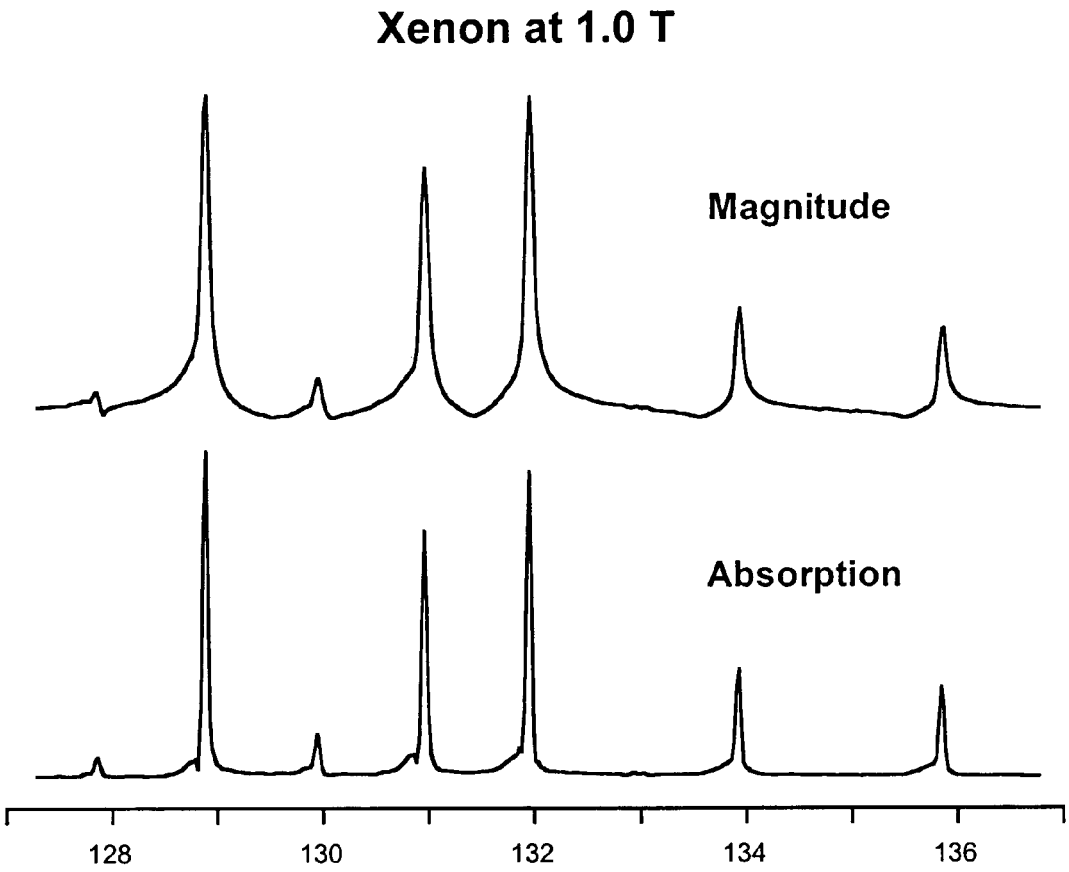
FIG. 11 shows an uncorrected magnitude mode xenon spectrum.
Figure 12:
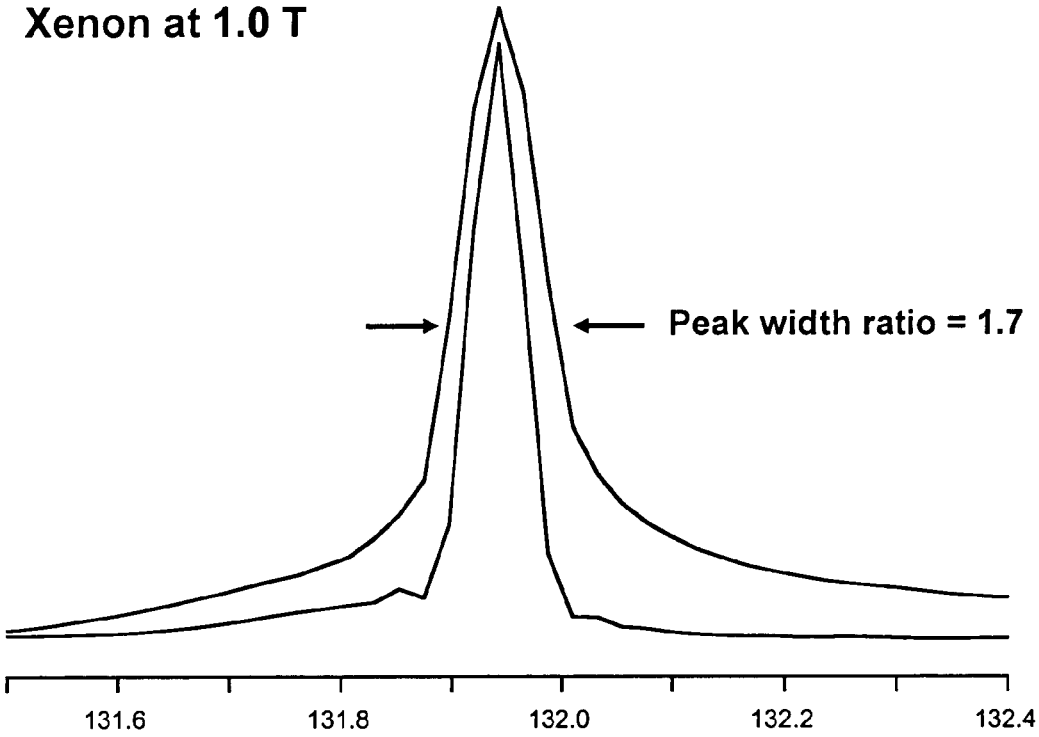
FIG. 12 shows the phase corrected absorption mode spectrum compared to the uncorrected magnitude mode xenon spectrum shown in FIG. 11 exhibiting a resolution enhancement factor of 1.7 for the peak around 132 m/z.

The feasibility of Fourier deconvolution based phase correction was initially demonstrated with EI spectra of xenon acquired on the 1.0 Tesla instrument. FIG. 11 shows an uncorrected magnitude mode xenon spectrum. FIG. 12 shows the phase corrected absorption mode spectrum obtained from the same time domain data which exhibits a resolution enhancement factor of 1.7 relative to the magnitude spectrum. This result is consistent with theory that predicts an enhancement factor ranging from 1.4 to 2.0 depending on system pressure and collision dynamics. The value of 1.7 corresponds to a pressure limited Langevin collision model where ion induced-dipole interactions dominate, as expected for low mass ions undergoing the relatively low velocity collisions prevailing at 1.0 Tesla in a small ICR cell.

Fourier deconvolution based phase correction was demonstrated with ESI spectra of ubiquitin obtained from the 9.4 Tesla system shown in FIG. 10. Ubiquitin samples were prepared as follows:

Bovine ubiquitin was purchased from Sigma (St. Louis, Mo.) and used without further purification. For electrospray, an aqueous 100 μM stock solution was diluted to 1 μM in 1:1 methanol (Baker):water with 2.5% acetic acid. Ions were externally accumulated in the front octopole for 0.1 s and then transferred through a quadrupole mass filter to a second (middle) octopole. This procedure was repeated three times, for a total accumulation period of 0.3 s. After accumulation, the ions were transferred from the middle octopole (modified to allow improved ejection of ions along the z-axis) through an octopole ion guide and captured by gated trapping in an open cylindrical cell. Simultaneous excitation (frequency sweep from 288 kHz to 96 kHz at 5 Hz/μs) and direct-mode broadband detection yielded a 2048 Kword transient. The spectra shown in FIGS. 13 and 14 are the result of 25 averaged transients.

Figure 13:
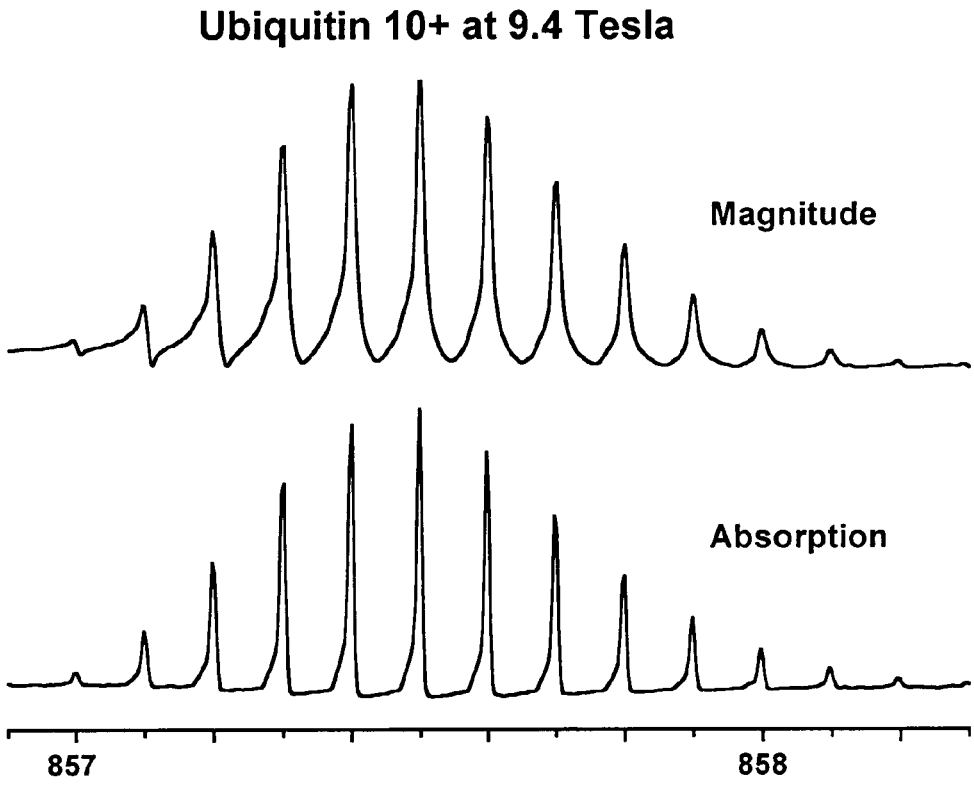
FIG. 13 shows an uncorrected magnitude mode ubiquitin spectrum.
Figure 14:
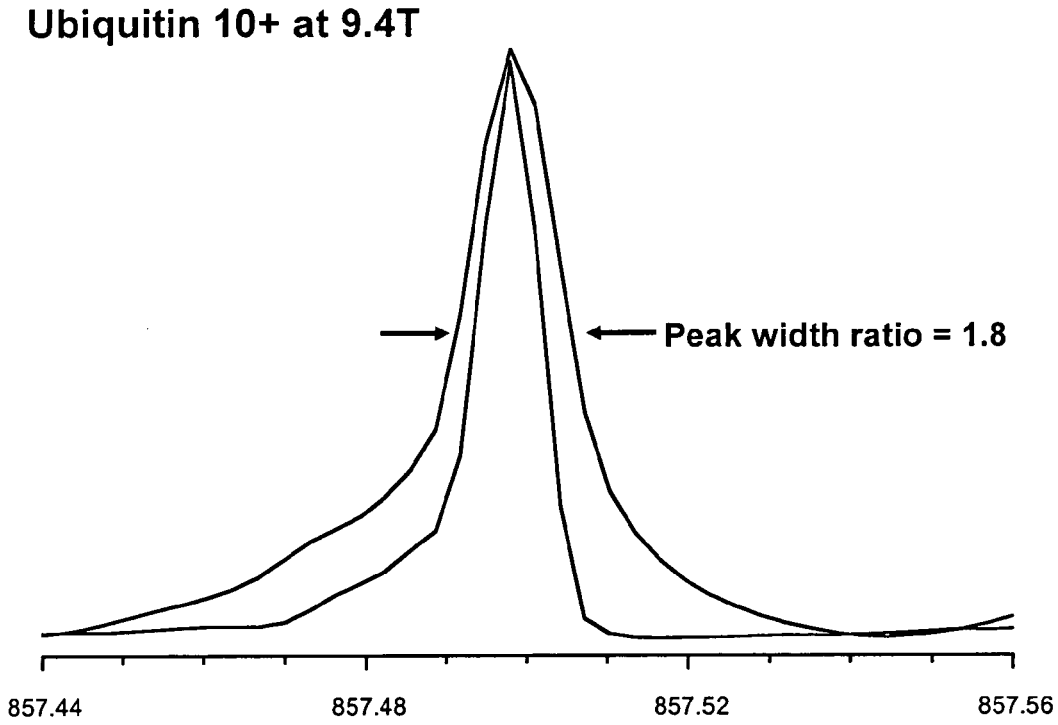
FIG. 14 shows the phase corrected absorption mode spectrum compared to the uncorrected magnitude mode ubiquitin spectrum shown in FIG. 13 exhibiting a resolution enhancement factor of 1.8 for the peak around 857.50 m/z.

FIG. 13 shows an uncorrected magnitude mode spectrum from the ubuquitin sample. FIG. 14 shows that the phase corrected absorption mode spectrum obtained from the same time domain data according to the invention exhibits a resolution enhancement factor of 1.8 relative to the magnitude spectrum. This factor approaches the theoretical limit of 2.0 and is consistent with the minimal signal damping observed over the detection interval. A detection interval long enough to reveal significant signal damping would yield a lower resolution enhancement factor, ultimately approaching a value near 1.4, as previously shown for high mass ions colliding with low mass neutrals (i.e. pressure limited hard-sphere collision dynamics).

The phase corrected spectra for both xenon (FIG. 12) and ubiquitin (FIG. 14) shown above exhibit evidence of peak "fronting". This asymmetry is also present in the uncorrected magnitude spectra, however, the broader base of the unphased peaks largely obscures it. In both cases, the asymmetry is apparently caused by frequency drift that occurs early in the time domain transients, perhaps due to evolution of ion cloud geometry and concomitant space charge effects immediately following excitation. Another possibility is that the fronting is related to the detected near-resonance ion motion that occurs during SED as the excitation waveform sweeps through the ion cyclotron resonance frequency. That the fronting is associated with the early part of the time domain data is evidenced by its disappearance when full, rather than half, apodization is employed. However, full apodization will result in significant negative side lobes in the absorption mode spectra and is therefore not compatible with the phasing process.

While various embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A high resolution Fourier Transform Ion Cyclotron Resonance (FT-ICR) mass spectrometry system, comprising:

excitation circuitry including an excitation amplifier for generating an electrical excitation signal and excitation electrodes for applying an oscillating electric field to excite ions in said system;

detection circuitry including detection electrodes for obtaining a detection signal comprising a plurality of signal values including signal values induced by said ions;

structure for reducing or canceling coupling of said excitation signal into said detection signal, wherein simultaneous excitation and detection is used;

computing structure for obtaining a Fourier transformed frequency domain representation of said detection signal and deconvolving said frequency domain representation using complex division to separate a dispersion spectrum portion and an absorption spectrum, portion.

2. The system of claim 1, wherein said Fourier transform comprises a fast Fourier transform (FFT).

3. The system of claim 1, wherein said structure for reducing or canceling coupling comprises at least one electrical network, said electrical network disposed between at least one of said detection electrodes and at least one of said excitation electrodes, said electrical network generating opposite-phase signals having substantially equal amplitudes to cancel signals associated with said excitation signal coupling into said detection signal.

4. The system of claim 1, wherein said electrical network comprises a variable capacitor.

5. The system of claim 1, wherein said structure for reducing or canceling coupling comprises a signal processor which implements an algorithm which identifies signal values in said plurality of signal values resulting from coupling of said excitation signal, and replaces said identified values with alternative values, said alternate values reducing effects of said coupling.

6. The system of claim 5, wherein said replacement values comprise zeros or an arithmetic average of said plurality of signal values excluding said identified signal values.

7. The system of claim 1, wherein ion cyclotron radii of said ions are less than about one half of a trapped-ion cell radius of said ions.

8. A high resolution method of Fourier Transform Ion Cyclotron Resonance (FT-ICR) mass analysis, said method comprising the steps of:

synchronizing ion excitation generated by an excitation signal and detection of ions generated by said ion excitation to be simultaneous, wherein a detection response comprising a plurality of signal values is obtained;

Fourier transforming said detection response to obtain a frequency domain representation of said detection response, and Fourier deconvolving said frequency domain representation using complex division to obtain an absorption spectrum separate from a dispersion spectrum.

9. The method of claim 8, wherein ion cyclotron radii of said ions are less than about one half of a trapped-ion cell radius of said ions.

10. The method of claim 8, further comprising the step of reducing or canceling a coupled excitation signal in said detection response by electronically combining substantially equal amplitude signals having opposite phases.

11. The method of claim 8, further comprising the steps of identifying signal values in said plurality of signal values resulting from coupling of said excitation excite signal, and replacing said identified values with alternative values, said alternate values reducing effects of said coupling.

12. The method of claim 11, wherein said alternative values comprise zeros or values equal to the arithmetic average of said plurality of signal values excluding said identified values.

13. The method of claim 8, wherein said ion excitation and said detection of ions begins at virtually the same instant in time.

* * * * *